US007115074B2

(12) United States Patent
Wu

(10) Patent No.: US 7,115,074 B2
(45) Date of Patent: Oct. 3, 2006

(54) TENDON STRETCHER

(76) Inventor: Shen Yi Wu, No.10, Gong-Yeii Lane, Feng Jeng Rd., Wufeng Shiang, Taichung (TW)

( * ) Notice: Subject to any disclaimer, the term of this patent is extended or adjusted under 35 U.S.C. 154(b) by 311 days.

(21) Appl. No.: 10/878,403

(22) Filed: Jun. 29, 2004

(65) Prior Publication Data

US 2005/0288160 A1 Dec. 29, 2005

(51) Int. Cl.
*A63B 23/02* (2006.01)
*A63B 21/04* (2006.01)

(52) U.S. Cl. ..... 482/51; 482/96; 482/907

(58) Field of Classification Search ..... 482/142, 482/51–53, 57, 90, 94–96, 907
See application file for complete search history.

(56) References Cited

U.S. PATENT DOCUMENTS 4,743,010 A * 5/1988 Geraci ..... 482/72
4,743,016 A * 5/1988 Van Derworp et al. ..... 482/93
5,299,997 A * 4/1994 Chen ..... 482/96
5,342,269 A * 8/1994 Huang et al. ..... 482/95
5,527,248 A * 6/1996 Crivello ..... 482/96
5,672,142 A * 9/1997 Wu ..... 482/96
6,676,577 B1 * 1/2004 Stearns ..... 482/142
6,726,609 B1 * 4/2004 Kuo ..... 482/143
6,733,429 B1 * 5/2004 Nizamuddin ..... 482/142

* cited by examiner

*Primary Examiner*—Stephen R. Crow
(74) *Attorney, Agent, or Firm*—Rosenberg, Klein & Lee

(57) ABSTRACT

A tendon stretcher including a base seat and a support frame which is pivotally mounted on the base seat and can be swung. A leaning pad and a saddle are fixedly connected on the support frame. An upward extending upright stem is disposed at one end of the base seat. A top end of the upright stem has a seat body for pivotally connecting with an extension bar. The bottom section of the seat body has an extending stop face. In addition, the seat body has a stop wall. A resilient body is disposed under the bottom of the extension bar corresponding to the stop face for abutting against the stop face. A pad body is disposed on one side of the extension bar corresponding to the stop wall for leaning against inner side of the stop wall.

6 Claims, 8 Drawing Sheets

TENDON STRETCHER

BACKGROUND OF THE INVENTION

The present invention is related to an improved tendon stretcher, and more particularly to a tendon stretcher in which the upright stem having handles for a user to hold has a certain flexibility.

FIG. 8 shows a conventional tendon stretcher having an I-shaped base seat 5. A support frame 6 is pivotally connected on the base seat 5. A saddle 61 and several pads 62 are mounted on the support frame 6. A user can sit on the saddle 61 with his/her legs leaning on the pads 62. Two pedals 63 are respectively pivotally disposed on the support frame 6 on two sides of the base seat 5 for the user's feet to tread. An upright stem 51 is disposed on the base seat 5 in front of the support frame 6. Two handles 52 are respectively mounted on two sides of top end of the upright stem 51 for the user to hold. In use, the user sits on the saddle 61 on his/her knees. The legs of the user lean on the pads 62 and the hands of the user hold the handles 52. By means of the strength of the hands, the user's body is pulled up and swung along with the support frame 6 so as to stretch the tendons of the user's body.

When the user's hands support and pull the user's body to swing, the user's hands apply a force on the handles 52 on two sides of the upright stem 51. However, the upright stem 51 is inflexible so that the hands and arms of the user often feel uncomfortable and tired. After a period of use, the hands and arms of the user may get injured.

Furthermore, when using the tendon stretcher, a user can stand on a transverse beam 53 behind the base seat 5. The user crotches and stands up with both hands holding the saddle 61 so as to stretch the tendons of the legs. However, the transverse beam 53 has a rectangular cross-section. When the user treads the transverse beam 53, the corners of the transverse beam 53 will exert a pressure onto the soles of the user. This will make the user feel uncomfortable or even painful.

SUMMARY OF THE INVENTION

It is therefore a primary object of the present invention to provide an improved tendon stretcher including a base seat and a support frame which is pivotally mounted on the base seat and can be swung. A front leg support and a rear leg support are respectively disposed at front end and rear end of the base seat. The support frame is pivotally connected on the base seat between the front and rear leg supports. The front leg support has an upward extending upright stem for pivotally connecting with an extension bar having two handles. A leaning pad and a saddle are fixedly connected on the support frame. The tendon stretcher is characterized in that top end of the upright stem has a seat body for pivotally connecting with the extension bar. A stop face extends from bottom section of the seat body toward the rear leg support. One side of the seat body opposite to the rear leg support has a stop wall. A resilient body is disposed under the bottom of the extension bar corresponding to the stop face for abutting against the stop face. A pad body is disposed on one side of the extension bar corresponding to the stop wall for leaning against inner side of the stop wall.

The user's hands apply a force on the handles on two sides of the extension bar which is pivotally connected in the seat body at the top end of the upright stem. The extension bar is equipped with the resilient body and pad body corresponding to the seat body. Accordingly, the back and forth swinging of the extension bar on the upright stem is resiliently restricted by the compressed resilient body and the pad body. Therefore, the extension bar has a certain flexibility, whereby when the user holds the handles and applies a force thereon, the user will feel more comfortable. This can avoid tiredness of the hands and arms of the user.

It is a further object of the present invention to provide the above tendon stretcher in which when the user stands on the rear leg support to crotch and stand up so as to stretch the tendons of the legs, the user's feet tread the rear leg support. The rear leg support is a tubular body with elliptic cross-section so that the user's feet will not feel uncomfortable. Moreover, the user's feet tread the arched section of the rear leg support, which has a curvature in conformity with the angle of the user's feet when standing. Therefore, the user can easily stand to stretch his/her tendons. In addition, the arched section is equipped with the slipproof pads for the user to tread so that the user can stably stand.

The present invention can be best understood through the following description and accompanying drawings wherein:

DETAILED DESCRIPTION OF THE PREFERRED EMBODIMENT

Figure 1:
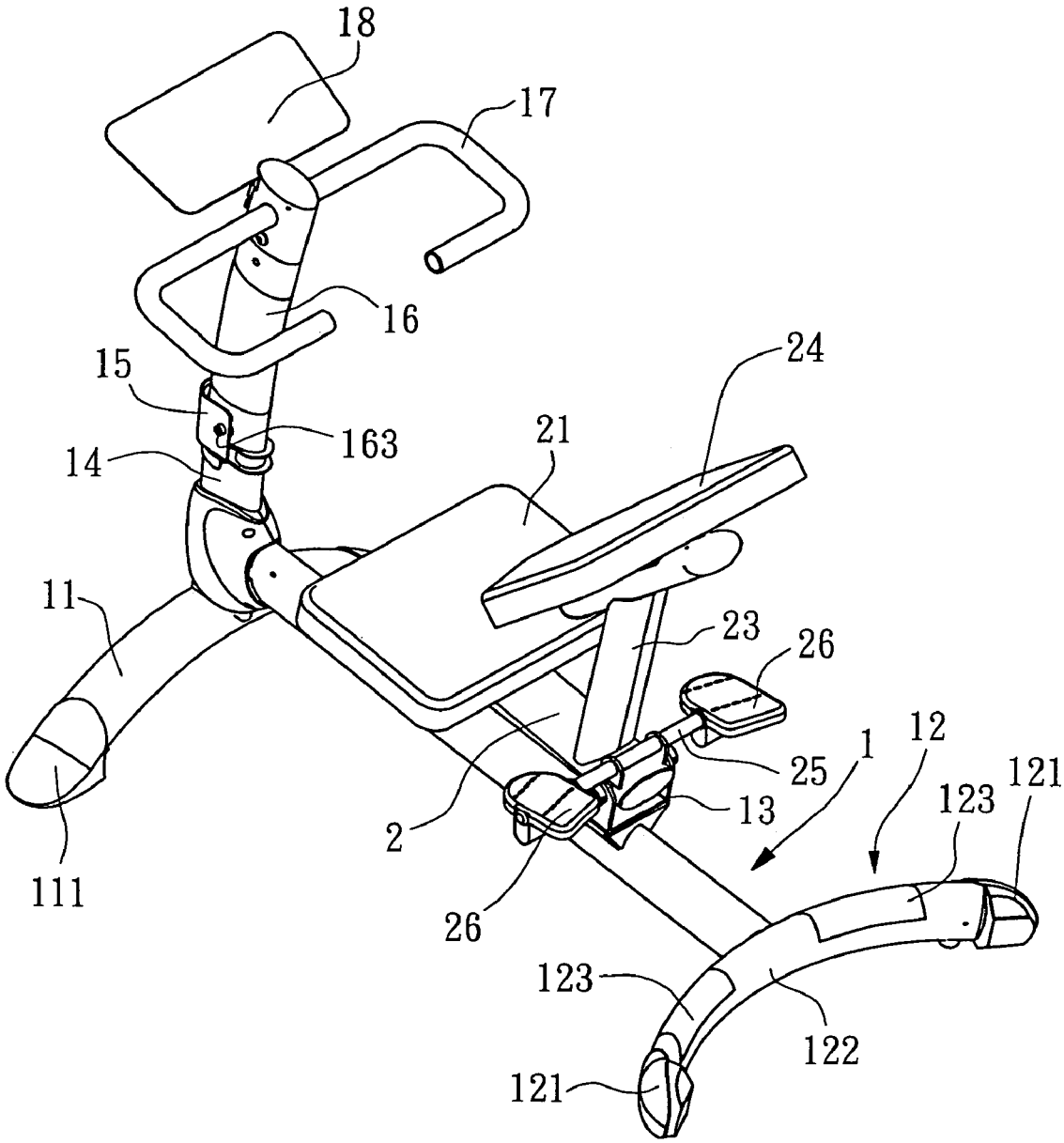
FIG. 1 is a perspective assembled view of the present invention.
Figure 2:
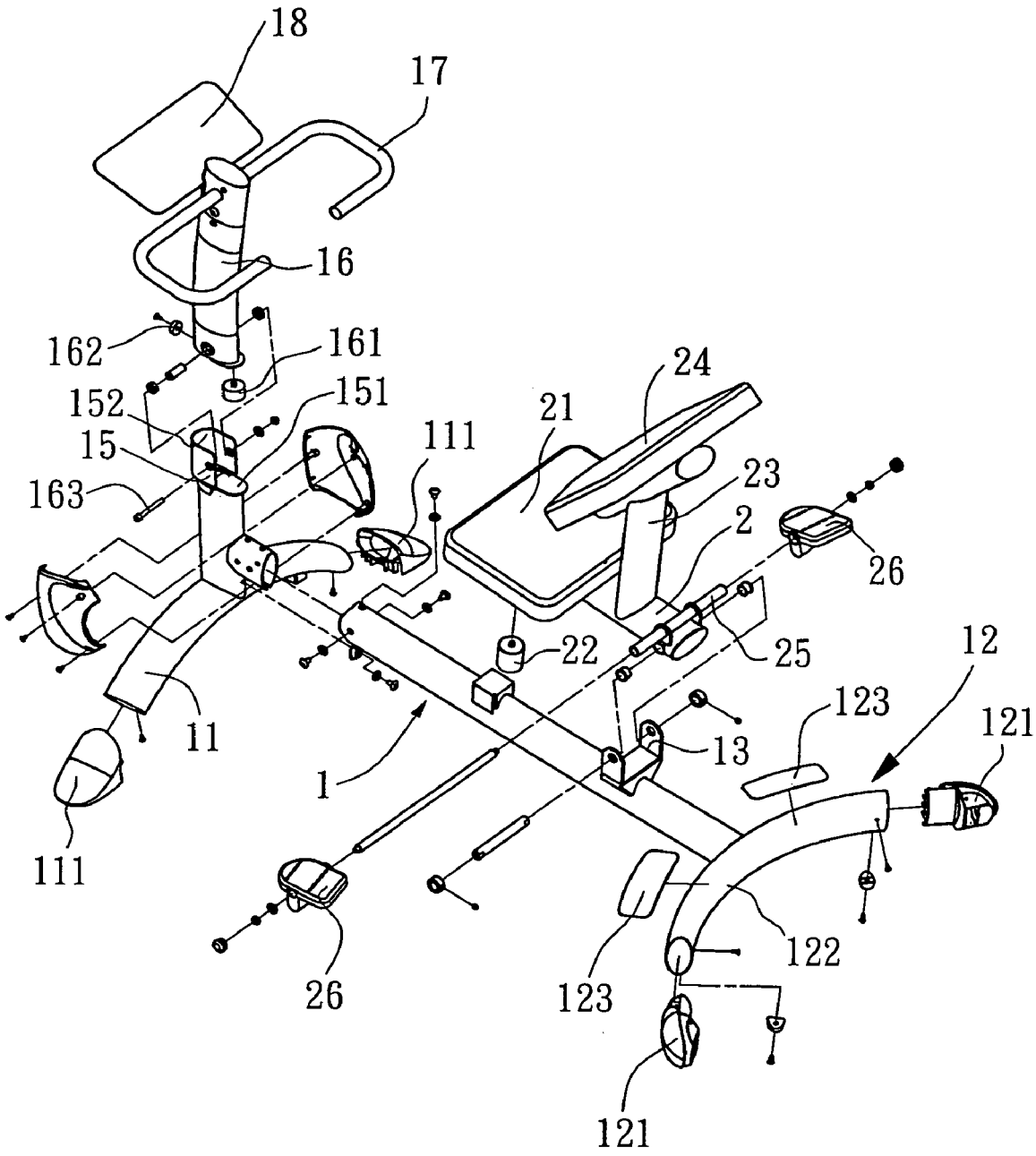
FIG. 2 is a perspective exploded view of the present invention.

Please refer to FIGS. 1 and 2. The tendon stretcher of the present invention includes a base seat 1 rested on the ground and a support frame 2 which is pivotally mounted on the base seat 1 and can be swung.

A front leg support 11 and a rear leg support 12 are respectively disposed at front end and rear end of the base seat 1. Two ends of each of the front and rear leg supports 11, 12 are respectively fitted with two pad members 111, 121 for stably supporting the base seat 1 on the ground. The base seat 1 has a pivot seat 13 between the front and rear leg supports 11, 12 for pivotally connecting with the support frame 2.

Figure 3:
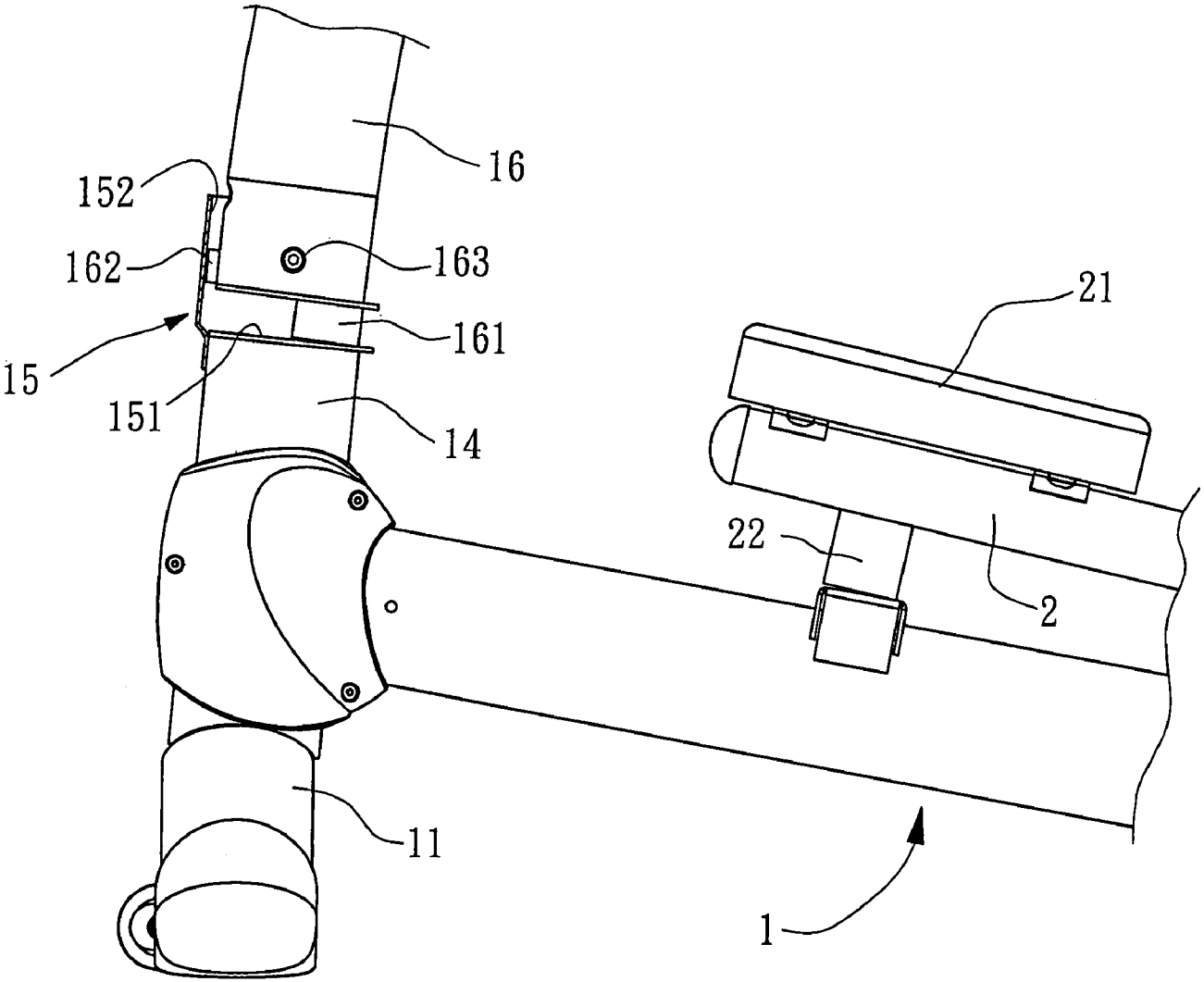
FIG. 3 is a partially sectional view of a part of the present invention.

The front leg support 11 has an upward extending upright stem 14. A top end of the upright stem 14 has a seat body 15 for pivotally connecting with an extension bar 16. A stop face 151 extends from bottom section of the seat body 15 toward the rear leg support 12. In addition, one side of the seat body 15 opposite to the rear leg support 12 has a stop wall 152. The stop face 151 and the stop wall 152 restrict the swinging gap of the extension bar 16. One end of the extension bar 16 has a shaft rod 163 for pivotally connecting the extension bar 16 in the seat body 15. A resilient body 161 is disposed under the bottom of the extension bar 16 corresponding to the stop face 151 for abutting against the stop face 151. In addition, a pad body 162 is disposed on one side of the extension bar 16 corresponding to the stop wall 152 for leaning against inner side of the stop wall 152 as shown in FIG. 3. The back and forth swinging gap of the extension bar 16 on the upright stem 14 is the compression gap of the resilient body 161 and the pad body 162. Accordingly, the extension bar 16 has a certain flexibility. The other end of the extension bar 16 opposite to the seat body 15 has two handles 17 on two sides of the extension bar 16 for a user to hold. A panel 18 is arranged in front of the other end of the extension bar 16 for resting a newspaper or a book thereon.

The rear leg support 12 is a tubular body with an elliptic cross-section. The rear leg support 12 has an arched section 122 extending to two sides of the base seat. Two slipproof pads 123 are disposed on the arched section 122 for a user to tread thereon without slippage.

One end of the support frame 2 is pivotally connected with the pivot seat 13 of the base seat 1. The other end of the support frame 2 extends toward the front leg support 11. A leaning pad 21 is fixedly mounted on the support frame 2. A buffer body 22 is disposed under the bottom of the support frame 2 opposite to the leaning pad 21. The buffer body 22 abuts against the base seat 1. A stem body 23 upward extends from a section of the support frame 2 near the pivot seat 13. A saddle 24 is fixedly connected with the stem body 23. One end of the support frame 2 pivotally connected with the pivot seat 13 has a pivot pin 25. Two pedals 26 are respectively pivotally connected at two ends of the pivot pin 25.

Figure 4:
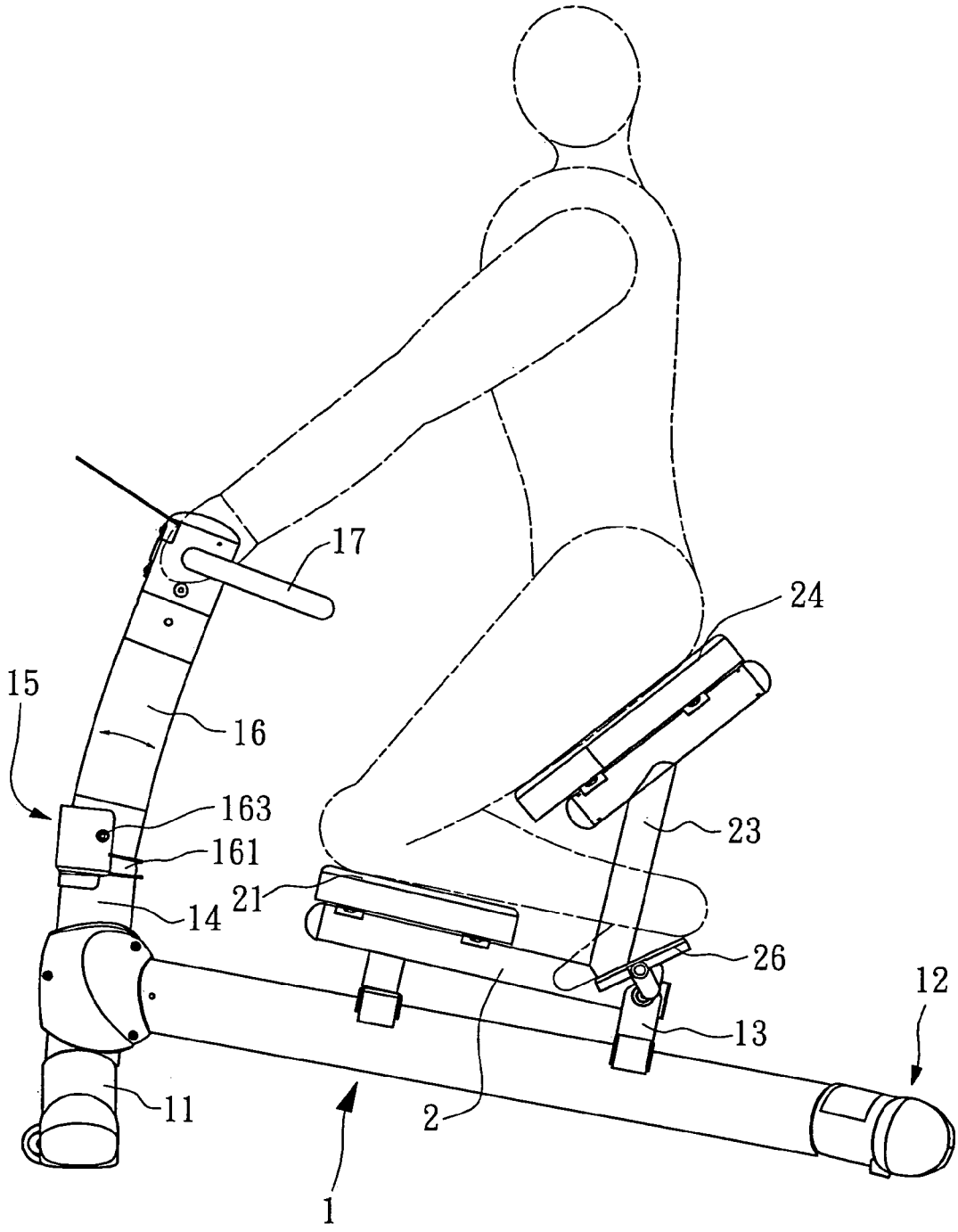
FIG. 4 shows the use of the present invention in one state.
Figure 5:
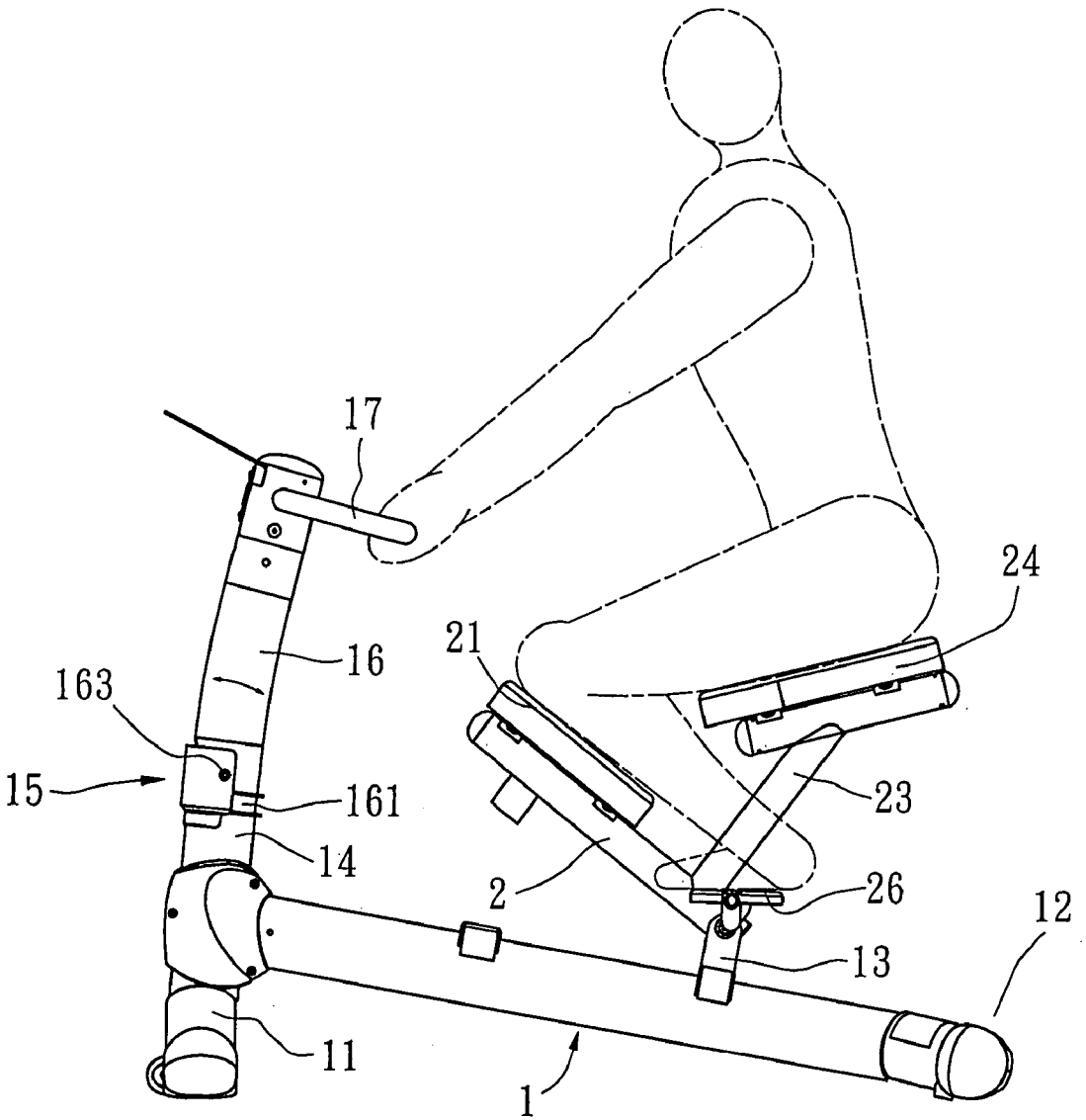
FIG. 5 shows the use of the present invention in another state.

In use, as shown in FIGS. 4 and 5, a user sits on the saddle 24 on his/her knees. The user's legs lean on the leaning pad 21 with two feet treading the pedals 26. The user's hands hold the handles 17 on two sides of the extension bar 16. By means of the strength of the hands, the user lifts or pulls his/her body and makes his/her body swing along with the support frame so as to stretch the tendons.

Figure 6:
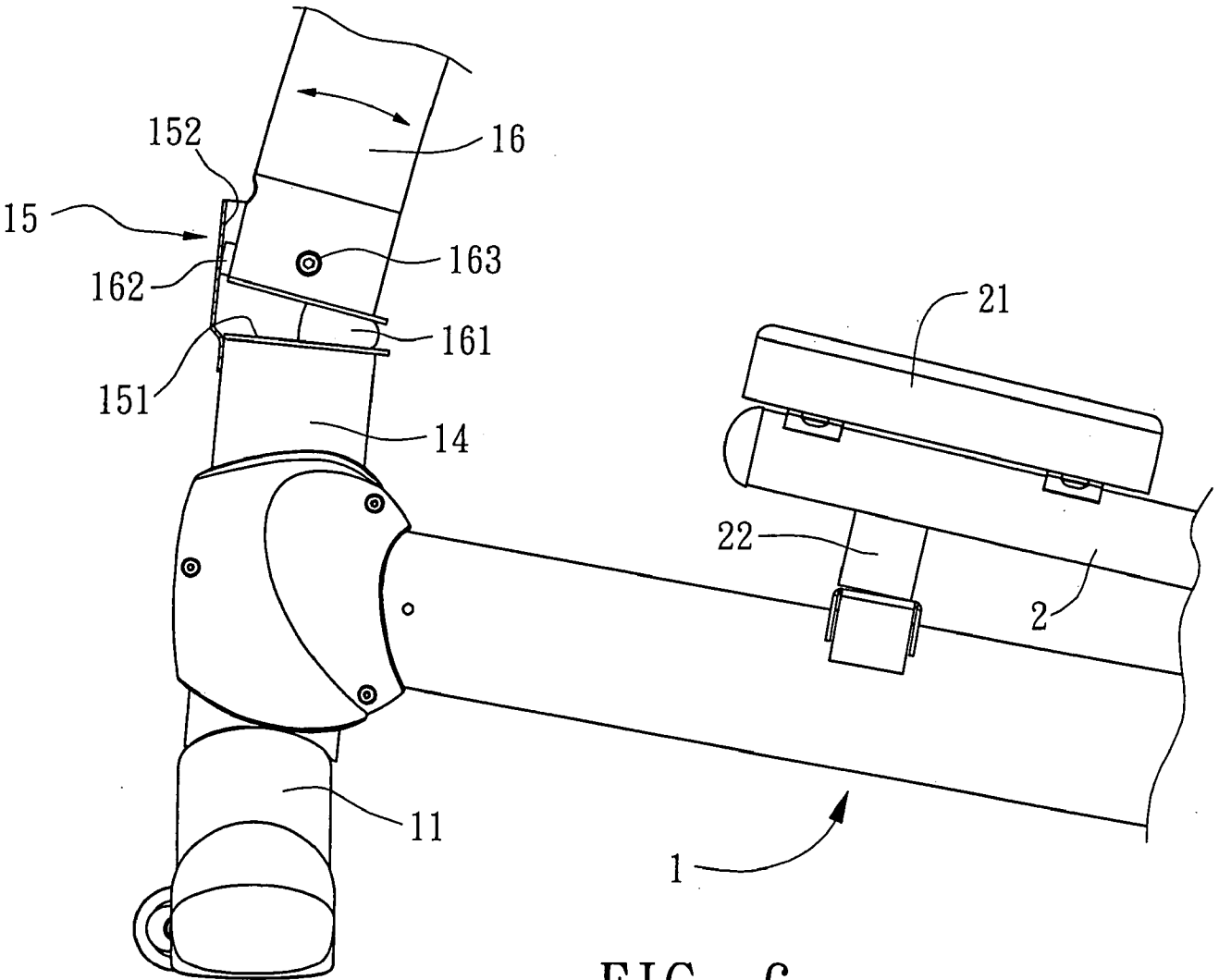
FIG. 6 shows that the resilient body and pad body of the extension bar of the present invention are resiliently compressed.

The user's hands apply a force on the handles 17 on two sides of the extension bar 16 which is pivotally connected in the seat body 15 at the top end of the upright stem 11. The extension bar 16 is equipped with the resilient body 161 and pad body 162 corresponding to the seat body 15. Accordingly, the back and forth swinging of the extension bar 16 on the upright stem 14 is resiliently restricted by the compressed resilient body 161 and the pad body 162 as shown in FIG. 6. Therefore, the extension bar 16 has a certain flexibility, whereby when the user holds the handles 17 and applies a force thereon, the user will feel more comfortable. This can avoid tiredness of the hands and arms of the user.

Figure 7:
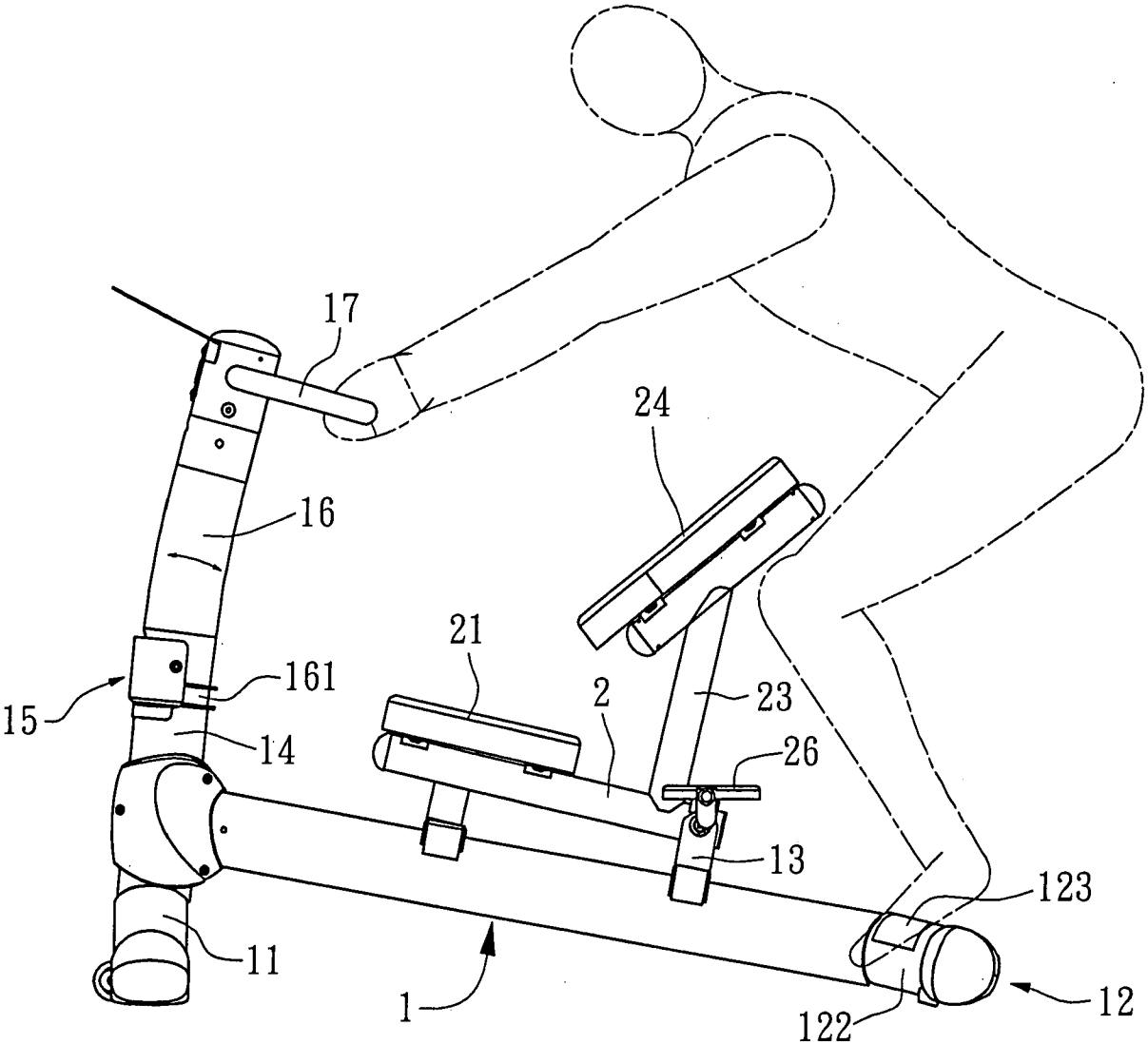
FIG. 7 shows that a user stands on the rear leg support of the present invention to stretch the tendons of his/her legs.
Figure 8:
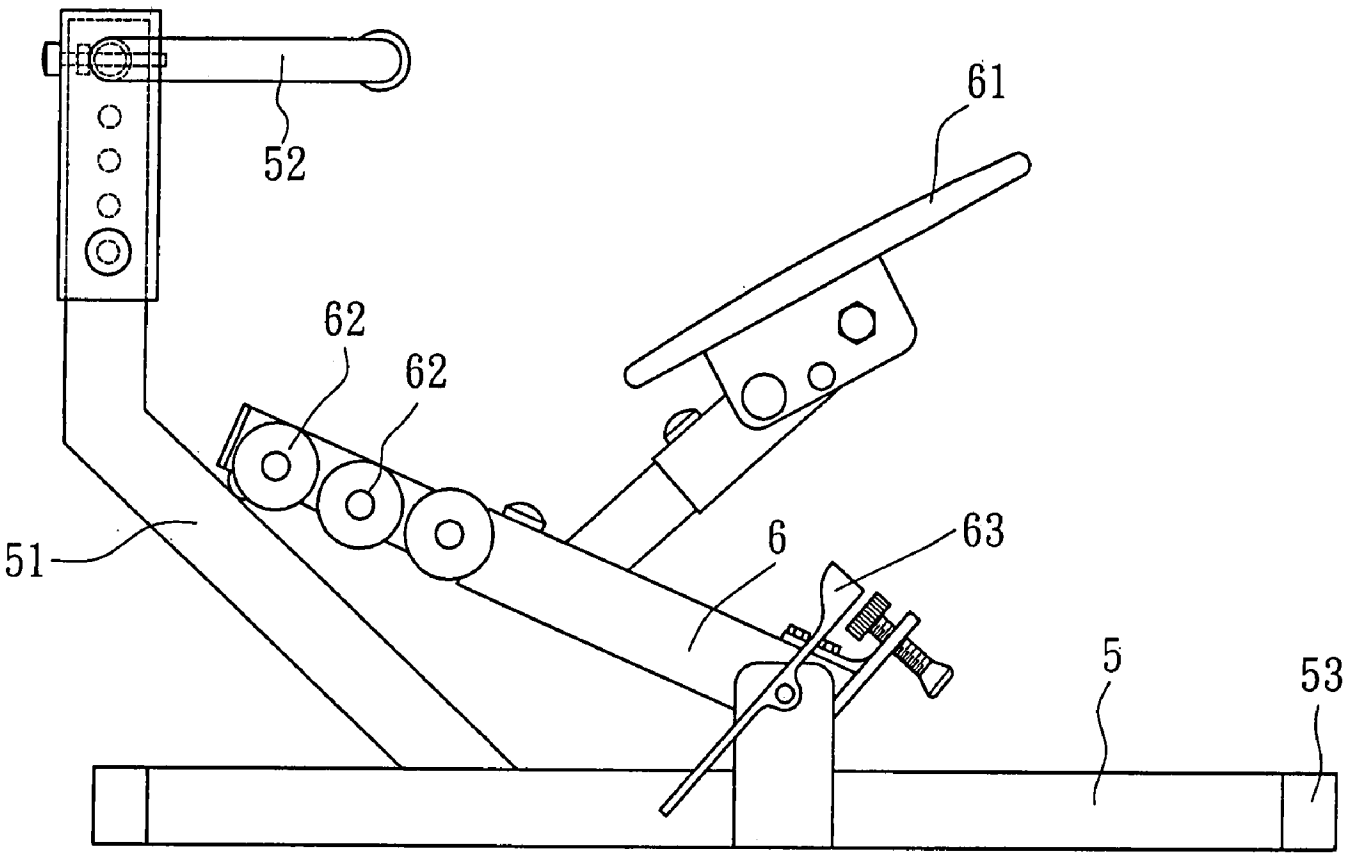
FIG. 8 PRIOR ART
FIG. 8 is a side view of a conventional tendon stretcher.

Furthermore, when the user stands on the rear leg support 12 to crotch and stand up so as to stretch the tendons of the legs as shown in FIG. 7, the user's feet tread the rear leg support 12. The rear leg support 12 is a tubular body with elliptic cross-section so that the user's feet will not feel uncomfortable. Moreover, the user's feet tread the arched section 122 of the rear leg support 12, which has a curvature in conformity with the angle of the user's feet when standing. Therefore, the user can easily stand to stretch his/her tendons. In addition, the arched section 122 is equipped with the slipproof pads 123 for the user to tread so that the user can stably stand.

The above embodiment is only used to illustrate the present invention, not intended to limit the scope thereof. Many modifications of the above embodiment can be made without departing from the spirit of the present invention.

What is claimed is:

1. A tendon stretcher comprising a base seat and a support frame which is pivotally mounted on the base seat and can be swung, a front leg support and a rear leg support being respectively disposed at a front end and a rear end of the base seat, the support frame being pivotally connected on the base seat between the front and rear leg supports, the front leg support having an upward extending upright stem for pivotally connecting with an extension bar having two handles, a leaning pad and a saddle being fixedly connected on the support frame, said tendon stretcher being characterized in that the top end of the upright stem has a seat body for pivotally connecting with the extension bar, a stop face extending from a bottom section of the seat body toward the rear leg support, one side of the seat body opposite to the rear leg support having a stop wall, a resilient body being disposed under the bottom of the extension bar corresponding to the stop face for abutting against the stop face, and a pad body being disposed on one side of the extension bar corresponding to the stop wall for leaning against the inner side of the stop wall.

2. The tendon stretcher as claimed in claim 1, wherein two ends of each of the front and rear leg supports are respectively fitted with two pad members for stably supporting the base seat on the ground.

3. The tendon stretcher as claimed in claim 1, wherein one end of the extension bar has a shaft rod for pivotally connecting the extension bar in the seat body, the other end of the extension bar opposite to the shaft rod having two handles on two sides of the extension bar for a user to hold, a panel being arranged in front of the other end of the extension bar for resting a newspaper or a book thereon.

4. The tendon stretcher as claimed in claim 1, wherein the rear leg support is a tubular body with an elliptic cross-section, the rear leg support having an arched section extending to two sides of the base seat, two slipproof pads being disposed on the arched section for a user to tread thereon.

5. The tendon stretcher as claimed in claim 1, wherein the base seat has a pivot seat between the front and rear leg supports for pivotally connecting with one end of the support frame, the other end of the support frame extending toward the front leg support, a leaning pad being fixedly mounted on the support frame, a buffer body being disposed under the bottom of the support frame opposite to the leaning pad, the buffer body abutting against the base seat, a stem body upward extending from a section of the support frame near the pivot seat, a saddle being fixedly connected with the stem body.

6. The tendon stretcher as claimed in claim 5, wherein one end of the support frame pivotally connected with the pivot seat has a pivot pin, two pedals being respectively pivotally connected at two ends of the pivot pin.

* * * * *